United States Patent [19]

Hermes et al.

[11] 3,969,049

[45] July 13, 1976

[54] ROTARY ENGINE ROTOR AND OIL SEAL CONFIGURATION

[75] Inventors: Walter L. Hermes, Cedar Grove; Robert C. Davis, Ramsey, both of N.J.

[73] Assignee: Curtiss-Wright Corporation, Wood-Ridge, N.J.

[22] Filed: July 17, 1975

[21] Appl. No.: 596,728

[52] U.S. Cl. ..... 418/91; 418/142

[51] Int. Cl.[2] ..... F01C 21/08; F01C 19/08

[58] Field of Search ..... 418/91, 61 A, 142, 94

[56] References Cited

UNITED STATES PATENTS

| | | | |
|---|---|---|---|
| 3,176,915 | 4/1965 | Bentele et al. | 418/61 A |
| 3,204,614 | 9/1965 | Huber | 418/91 X |
| 3,369,740 | 2/1968 | Abermath | 418/61 A |
| 3,390,667 | 7/1968 | Beurtheret | 418/94 X |
| 3,400,939 | 9/1968 | Jones | 418/142 X |
| 3,655,302 | 4/1972 | Hermes et al. | 418/61 A |
| 3,802,810 | 4/1974 | Reitz | 418/61 A |

*Primary Examiner*—C. J. Husar
*Assistant Examiner*—Leonard Smith
*Attorney, Agent, or Firm*—Victor D. Behn; Arthur Frederick

[57] ABSTRACT

An improved oil seal arrangement for a rotary engine in which one side of the rotor has an adapter ring attached thereto with the ring having circumferentially-spaced ribs aligned with the internal partitions of the rotor and in which the outer periphery of the adapter ring has an annular notch to provide an annular recess between the ring and rotor to receive therein an oil seal assembly, and in which the other side of the rotor has a gear ring attached to the rotor with the gear ring having circumferentially-spaced ribs aligned with the internal partitions of the rotor and in which the outer periphery of the rotor gear ring has an annular notch to provide an annular recess between the gear ring and rotor to receive an oil seal assembly.

9 Claims, 6 Drawing Figures

ROTARY ENGINE ROTOR AND OIL SEAL CONFIGURATION

BACKGROUND OF THE INVENTION

This invention relates to rotary mechanisms for fluid pumps, fluid expansion engines, internal combustion engines and the like. In particular, the invention is directed to an improvement of the rotor and oil seal configuration shown in prior U.S. Pat. No. 3,655,302 granted on Apr. 11, 1972 on an invention of Hermes et al. That patent discloses an oil cooled rotor for a rotary mechanism in which the rotor interior is divided into a plurality of compartments by a plurality of circumferentially spaced partitions into which compartments cooling oil is sequentially supplied and drained as more fully disclosed in prior U.S. Pat. No. 3,176,915 granted on Apr. 6, 1965 to Bentele et al.

In rotary mechanisms of the type shown in said prior patents including that shown in said Hermes et al patent, only one side of the rotor has a gear attached to the rotor. Because of this non-symmetry, the arrangement of the Hermes et al patent results in the rotor having substantially different oil cooling flow paths on each rotor side. As a result, the cooling effectiveness of the rotor cooling oil differs on the two sides of the rotor.

Also, in said Hermes et al patent, the inner portion of the rotor side wall on the anti-gear side of the rotor is interrupted by holes providing access to the rotor gear attaching bolts. As a result of these interruptions, the radially inner portions of the rotor side wall on the anti-gear side of the rotor is not as effective in maintaining an oil film between it and the adjacent side housing for the purposes as set forth in prior U.S. Pat. No. 3,261,542 granted on July 19, 1966 to Jones, as would be the case in the absence of said interruptions. The rotor configuration of this Jones patent is commonly termed, a wet hub rotor in which the rotor hub not only functions as an axial thrust bearing for the rotor but also serves to minimize the quantity of oil otherwise reaching the oil seal.

SUMMARY

It is an object of the invention to provide a novel composite rotor and seal construction for a rotary mechanism in which the foregoing problems with the Hermes et al patent are avoided.

It is a further object of the invention to provid a novel rotor and seal construction for a rotary mechanism in which the rotor is provided with a gear ring at one of its axial end faces and an adapter ring is provided at the other end face of the rotor and rotor oil seals are provided between said rings and the rotor and in which each of said rings extend axially beyond the adjacent end face of the rotor to locate the rotor between the end walls of the housing of said mechanisms so as to provide a continuous wet hub at each end face of the rotor.

A still further object of the invention comprises the provision of a rotor construction for a rotary mechanism in which the rotor hub has a gear ring secured thereto at one end of the rotor axial end faces and an adapter ring is secured to the rotor hub at the other rotor end face and in which both of said rings are provided with circumferentially-spaced ribs which are aligned with circumferentially-spaced partitions dividing the interior of the rotor with compartments through which oil is circulated for cooling the rotor. The aligned ribs on said gear and adapter rings thereby serve to improve equally the oil scavenging on both sides of the rotor from said rotor. compartments. Also, in accordance with the invention, each of said rings is piloted or has a snug fit at the inner ends of its ribs on an annular surface formed on the rotor hub. This method of fitting the two rings on the rotor permits substantial thermal expansion and contraction between the rotor and rings without generating high thermal stresses in either.

Further, in accordance with the invention, the rotor oil seals on each side of the rotor are located between the associated ring (adapter or gear ring) and the adjacent portion of the rotor with the secondary oil seal, usually an O-ring, seating directly on the rotor. This feature eliminates the need for special oil-tight fit between each of these rings and the adjacent portion of the rotor.

Other objects of the invention will become apparent upon reading the annexed detailed description in connection with the drawings.

DESCRIPTION OF PREFERRED EMBODIMENT

Figure 2:
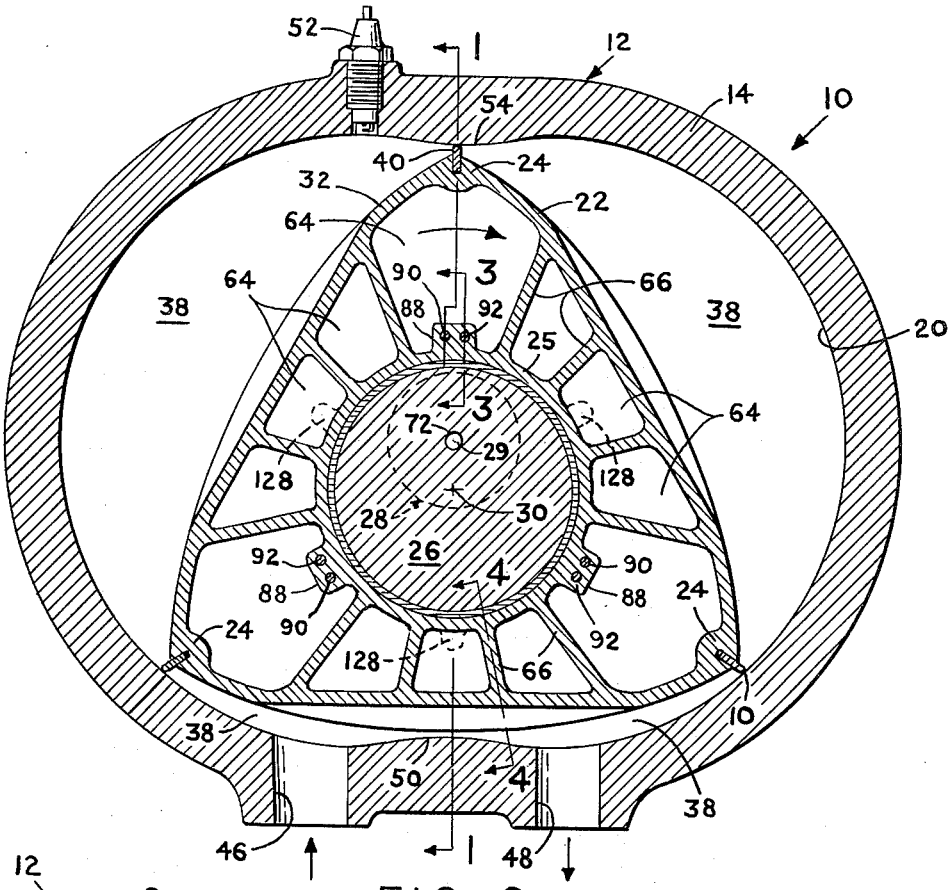
FIG. 2 is a sectional view taken along line 2—2 of FIG. 1.
Figure 1:
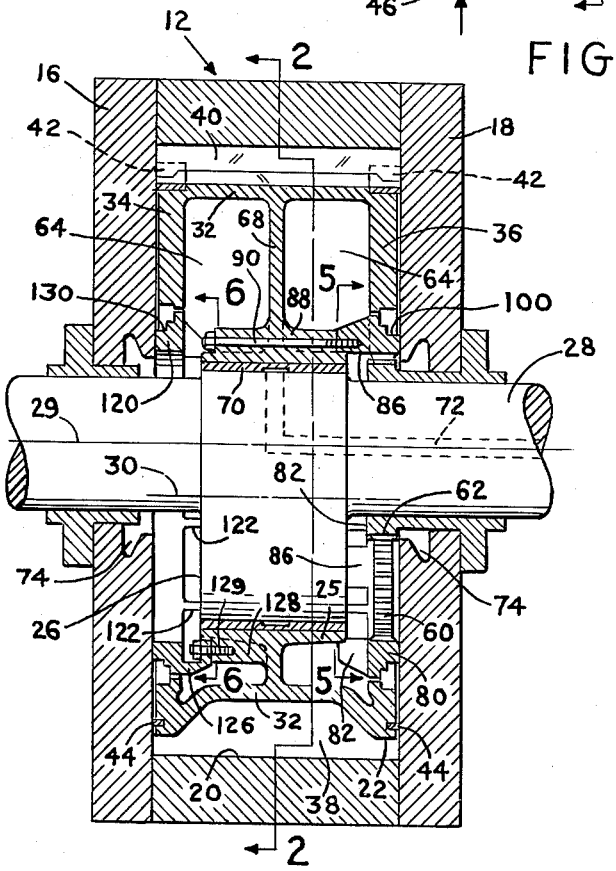
FIG. 1 is an axial sectional view through a rotary combustion engine embodying the invention and taken along line 1—1 of FIG. 2.
Figure 3:
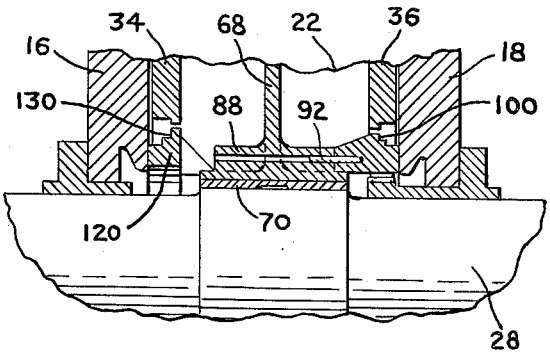
FIG. 3 is a partial sectional view taken along line 3—3 of FIG. 2.

Referring particularly to FIGS. 1 and 2 of the drawing, a rotary combustion engine is schematically indicated at 10, the engine being similar to that described in the aforementioned patents. Although the invention is described herein in connection with a rotary combustion engine, it will become apparent that the invention is also applicable to similar rotary mechanisms designed for operation, for example, as a rotary compressor or expansion engine.

The engine 10 comprises an outer body or housing 12 consisting of an intermediate or rotor housing 14 and two axially spaced end housings 16 and 18 secured together so as to form an engine cavity therebetween. The peripheral inner surface 20 of the rotor housing 14, as viewed in FIG. 2, has a multi-lobe profile which preferably is essentially an epitrochoid and, as illustrated, has two lobes.

A hollow inner body or rotor 22 having a plurality of apex portions 24 is disposed within the engine cavity and has a hub portion 25 which is journaled on the eccentric portion 26 of a shaft 28 extending coaxially through the end housings 16 and 18, the axes of the shaft 28 and rotor 22 being indicated at 29 and 30 respectively. When a two-lobe peripheral inner surface 20, the rotor 22 has a generally triangular profile. The rotor 22 has a triangular peripheral wall portion 32 and two axially spaced end walls 34 and 36 extending radially inwardly from its peripheral wall 32. The apex portions 24 of the rotor 22 have sealing cooperation with the peripheral inner surface 20 of the housing to form a plurality of working chambers 38 between the rotor and said surface. For this purpose, each apex portion 24 of the rotor has apex seals 40 extending thereacross in a rotor groove disposed parallel to the rotor axis. In addition, a cylindrical seal pin 42 is disposed at each end of the rotor apex seal groove and each rotor end wall is provided with side seal strips 44 disposed in grooves in their respective rotor end walls 34 or 36 and extending between adjacent seal pins 42. In this way the apex seals 40, the seal pins 42 and the side seal strips 44 form a seal grid around each working chamber 38.

The outer body or engine housing 12 is also provided with an intake port 46 and an exhaust port 48 disposd adjacent to and on opposite sides of one of the junctions 50 of the two-lobe peripheral surface 20, and a spark plug 52 is disposed adjacent to the opposite junction 54 of said two lobes.

An internal gear 60 is coaxially secured (as hereinafter described) to the rotor 22 adjacent to the rotor end wall 38 and a fixed external gear 62 is coaxially secured to the adjacent end housing 18. The gearing 60 and 62 control the planetary rotation of the rotor relative to the engine shaft 28 and housing 12.

The rotor interior is divided into a plurality of compartments 64 by partitions 66 which interconnect the rotor peripheral wall 32, side walls 34 and 36 and hub 25. In addition, the rotor may, as illustrated, have a central transverse web 68 extending from the rotor peripheral wall 32 to the rotor hub 25. A suitable bearing sleeve 78 is disposed between the rotor hub 25 and shaft eccentric 26. Lubricating oil is supplied to the bearing sleeve 70 by means of a passage 72 in the shaft 28. This lubricating oil spills out from the ends of the bearing 70 and is thrown radially outwardly sequentially into the rotor compartments 64, for example, as disclosed in aforementioned U.S. Pat. No. 3,176,915. As also disclosed in this latter patent, special nozzles may be provided for directing oil from the shaft 28 and/or its eccentric 26 into the rotor compartments 64. Because of the planetary rotation of the rotor 22 and because the interior of the rotor is divided by the partitions 66 into compartments 64, the oil within each compartment is forced to rotate substantially with the rotor and therefore the centrifugal forces on the oil in each rotor compartment 64 periodically reverses. Accordingly, the oil is periodically scavenged radially inwardly from the rotor compartments 64 into the annular gutters 74 from which the oil drains through passges (not shown).

Figure 4:
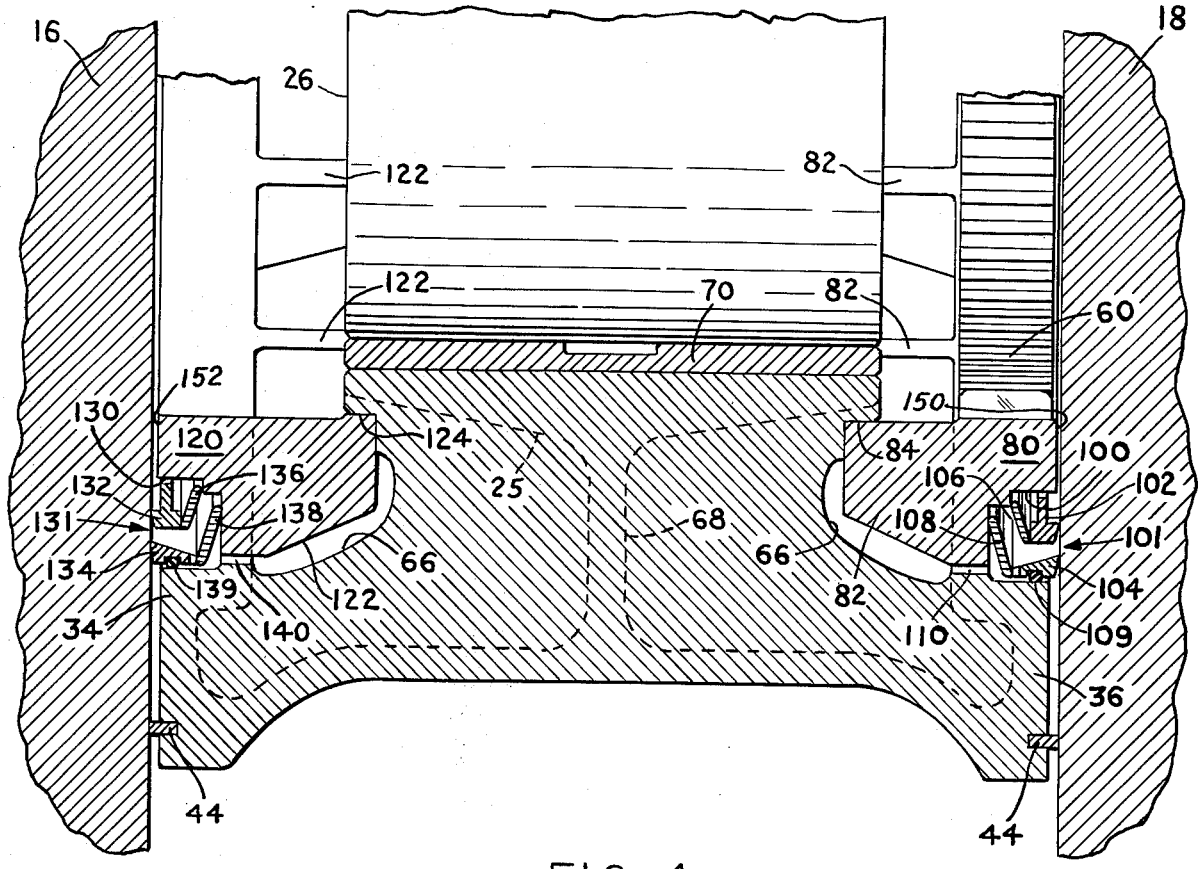
FIG. 4 is an enlarged sectional view taken along line 4—4 of FIG. 2.
Figure 5:
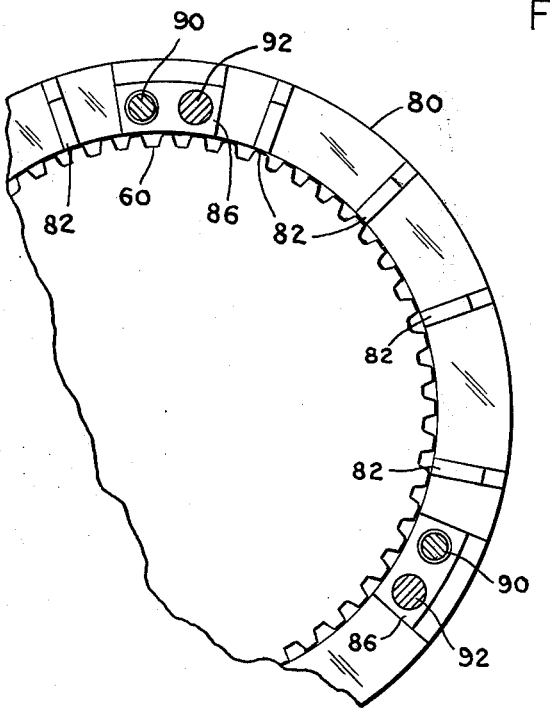
FIG. 5 is an enlarged partial view of the gear ring taken along line 5—5 of FIG. 1.
Figure 6:
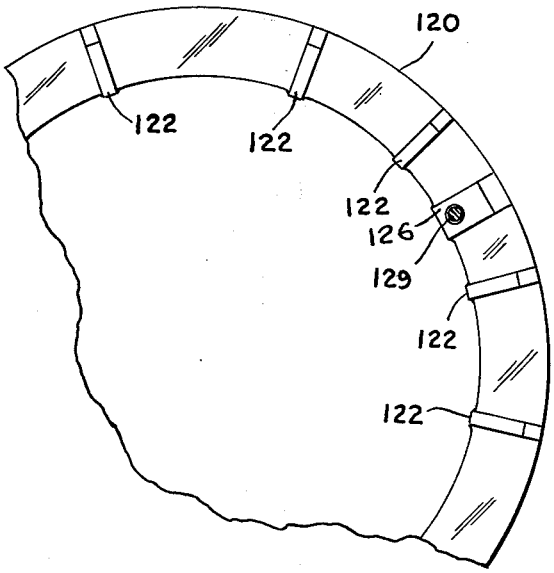
FIG. 6 is an enlarged partial view of the adapter ring taken along line 6—6 of FIG. 1.

The engine structure, so far described, is conventional. The internal rotor timing gear 60 is formed on a ring 80 which is disposed radially inwardly of the rotor end wall 36. The gear ring 80 is provided with a plurality of circumferentially-spaced ribs 82, there being one such rib 82 for each rotor partition 66. As best seen in FIG. 4, each gear ring rib 82 extends axially inwardly in alignment with its associated rotor partition 66 so as to, in effect, form an extension of said partition. The axially inner portion of each gear ring rib 82 is snugly fitted or piloted on an external surface 84 formed on the adjacent end of the rotor hub 25. This mode of fitting the gear ring 80 to the rotor hub provides a great degree of flexibility in absorbing thermal growth between the gear ring and rotor without generating high stresses in either the gear ring or in its supporting rotor structure. This is so because each section of the continuous ring portion of the ring 82 can readily rotate torsionally about its center of mass to accommodate relative thermal growth between the rotor hub and ring.

The gear ring 80 is also provided with a plurality of circumferentially-spaced bosses 86 (three as illustrated) which are aligned with corresponding bosses 88 formed on the rotor hub 25. The hub bosses 88 extend axially across the rotor hub and a bolt 90 extends from the remote side of the rotor hub through each hub boss 88 and threads into a tapped hole in the gear ring boss 86 for securing the gear ring to the rotor hub. The long shanks of these gear attaching bolts 90 provide the bolts with sufficient flexibility in tension to maintain axially clamping of the gear ring 82 to the rotor under all engine operating conditions. In addition, in ordr to accurately locate the rotor timing gear 60 rotatively relative to the rotor, each rotor hub boss 86 is provided with a dowel pin 92 which extends into a bore in the gear ring 80.

The gear ring 80 has an annular stepped notch 100 at its radially outer periphery, this notch facing radially outwardly and axially outwardly from the rotor 22. The annular notch 100 cooperates with the inner periphery of the adjacent end wall 36 of the rotor to form an annular groove for reception of the rotor oil seal structure 101. For reasons of clarity, this oil seal structure 101 is not shown in FIG. 1 but is shown in the enlarged view of FIG. 4. As illustrated in FIG. 4, this oil seal structure 101 is generally similar to that shown in prior U.S. Pat. No. 3,400,939 granted on Sept. 10, 1968 to Jones, in that it consists of a pair of radially-spaced oil seal rings 102 and 104 which are urged axially outwardly against the adjacent housing end wall 18 by Belleville-type springs 106 and 108 respectively. The outer oil seal ring 104 is provided with an annular groove on its radially outer side within which annular seal element 109 is disposed to provide a seal between the seal ring 104 and the adjacent inner surface of the rotor end wall 36. The seal element 109 preferably is an O-type ring of elastomeric material.

The gear ring 80 is spaced radially inwardly from the adjacent rotor end wall 38 to leave an annular gap or passage 110 therebetween. Accordingly, any oil which accumulates between the oil seal rings 102 and 104 can readily drain into the rotor compartments 64 through the gap 110. For this purpose, the radially outer oil seal ring 104 is notched at its point of contact with the spring 108 (as better shown in aforementioned U.S. Pat. No. 3,400,939) to permit oil flow therebetween and through the gap 110 into the rotor compartments 64.

An adapter ring 120 is secured on the side of the rotor opposite to the gear ring 80. The adapter ring 120 is similar to the gear ring 80 except it does not include an internal gear, such as the gear 60 formed on the gear ring 80. Thus, the adapter ring 120 has a plurality of circumferentially-spaced ribs 122, there being one such rib 122 for each rotor partition 66. Each rib 122 extends axially inwardly in alignment with its associated rotor partition 66 so as to form an extension of said partition. As in the case of the gear ring ribs 82, the axially inner portions of the adapter ring ribs 122 are snugly fitted or piloted on external surfaces 124 formed on the adjacent end of the rotor hub 25.

The adapter ring 120 is also provided with a plurality of circumferentially-spaced bosses 126 (three, as illustrated) which are aligned with corresponding bosses 128 formed on the rotor hub 25. The rotor hub bosses 128 preferably are disposed circumferentially midway between the rotor hub bosses 88 but are disposed only on the adapter ring side of the rotor hub. Each rotor hub boss 128 is provided with a threaded stud 129 which passes through a hole in the associated boss 126 on the adapter ring 120 for attachment of the adapter ring by means of a threaded nut. Since the adapter ring 120 does not incude a rotor timing gear such as the gear 60, no dowels are provided or needed for accurately locating the rotative position of the adapter ring on the rotor.

As in the case of the gear ring 80, the adapter ring 120 has an annular stepped notch 130 at its radially outer periphery, with said notch facing radially outwardly and axially outwardly from the rotor. The annular notch 130 cooperates with the inner periphery of the adjacent rotor end wall 34 to form an annular groove for the reception of the rotor oil seal structure 131. This oil seal structure is similar to that in the annular notch 100 on the gear side of the rotor and consists of a pair of radially-spaced oil seal rings 132 and 134 which are urged axially outwardly against the adjacent housing end wall 16 by Belleville-type springs 136 and 138 respectively. The outer oil seal ring 134 is provided with an annular groove on its radially outer side within which an O-type ring 139 of elastomeric material is disposed to provide a seal between the seal ring 134 and the adjacent inner surface of the rotor end wall 36. In addition, the adapter ring 120 is spaced radially inwardly from the adjacent rotor end wall 36 to leave an annular gap or passage 140 therebetween. Accordingly, any oil which accumulates between the oil seal rings 132 and 134 can readily drain into the rotor compartments 64 through the gap 140. Again, as in the case of the oil seal 104, the oil seal ring 134 is notched at its point of contact with the spring 138 to permit oil flow therebetween and thence through the gap 140 into the rotor compartments 64.

The portions of the gear ring 80 and the adapter ring 120 disposed radially inwardly of their associated oil seals 101 and 131 are dimensioned so that their axially outer surfaces 150 and 152 respectively protrude axially beyond the adjacent rotor end walls 36 and 34 respectively. The surfaces 150 and 152 of the rings 80 and 120 respectively, have only a small running clearance with the housing end walls 16 and 18 whereby these surfaces serve to locate the rotor 22 between said housing end walls 16 and 18. The surfaces 150 and 152 of the rings 80 and 120 respectively are well lubricated by oil spilling from the ends of the bearing 70 and by oil draining from the rotor internal compartments 64 whereby said surfaces also function as an axial thrust bearing for the rotor. Because of the small clearance between the ring surfaces 150 and 152 and the housing end walls 16 and 18 and because both these surfaces are continuous annular surfaces, they serve to minimize the quantity of oil reaching the oil seals 101 and 131 whereby these surfaces 150 and 152 cooperate with the oil seals to minimize any oil leakage along the housing end walls toward the engine working chambers 38.

With the rotor structure described, the gear ring 80 and adapter ring 120 are substantially similar except for the provision of gear teeth 60 on the ring 80. Accordingly, there is a substantially similar annular space between each of these rings and the rotor hub 25 for the supply of lubricating oil to aid drainage of lubricating oil from the rotor internal compartments 64. Because of this fact and because the rings 80 and 120 have similar ribs 82 and 122 respectively, forming extensions of the rotor partitions 66, the lubricating oil entering and leaving the rotor compartments produces substantially equal cooling on both sides of the rotor. Also, because the ribs 82 and 122 form extensions of the rotor partitions 66, scavenging of oil from the rotor compartments 64 is improved thereby improving the effectiveness of the oil in cooling the rotor.

While the present invention has been described in detail in its present preferred embodiment, it will be obvious to those skilled in the art, after understanding the invention, that various changes and modfications may be made without departing from the spirit and scope of the invention. For example, the invention is not limited to the use of the specific oil seals 101 and 131 illustrated. It is intended by the appended claims to cover all such modifications.

What is claimed is:

1. A composite rotor for a rotary mechanism including a housing having a pair of axially-spaced end walls and a peripheral wall between said end walls to form a cavity therebetween and a shaft coaxial with said cavity and having an eccentric portion disposed within said cavity and upon which said rotor is journaled for relative rotation and for cooperation with the inner multilobe surface of said peripheral wall to form a plurality of working chambers between said rotor and peripheral wall surface, said composite rotor comprising:

a. a main rotor portion having a peripheral wall, a pair of axially-spaced end walls at opposite sides of said rotor and extending radially inwardly from said peripheral wall, a hub portion and a plurality of circumferentially-spaced partitions interconnecting said hub portion with said end walls and peripheral wall and dividing the interior of the rotor into a plurality of circumferentially-spaced compartments;

b. a pair of rings coaxially disposed adjacent to and radially inwardly of said opposite rotor end walls with each of said rings being secured to the rotor hub portion at circumferentially-spaced points to leave a substantial annular gap between said ring and the adjacent end of the rotor hub portion and with one of said rings having internal gear teeth formed thereon, each of said rings having circumferentially-spaced ribs extending axially inwardly across said annular gap and disposed in alignment with said rotor partitions;

c. seal means disposed between the radially facing surfaces of each of said rings and the adjacent rotor end wall for sealing cooperation with the adjacent housing end wall; and d. means for supplying cooling oil to said rotor compartments for drainage through said annular gaps at each side of the rotor hub portion.

2. A composite rotor as claimed in claim 1 and in which each said ring and the rotor hub portion have cooperating bosses for attachment of the ring to said hub portion.

3. A composite rotor as claimed in claim 1 and in which the inner portions of the ribs of each of said rings have a snug fit with surface means on the adjacent end of the rotor hub portion.

4. A composite rotor as claimed in claim 1 and in which each of said rings has a continuous annular surface which projects axially outwardly beyond the adjacent rotor end wall.

5. A composite rotor as claimed in claim 4 and in which the continuous annular surface of each said ring is disposed radially inwardly of said seal means.

6. A composite rotor as claimed in claim 1 and in which each said ring has an annular notch at its outer edge opening axially and radially outwardly with its associated seal means being disposed in said notch.

7. A composite rotor as claimed in claim 6 and in which each said seal means incudes a pair of radially-spaced annular seal rings for sealing cooperation with the adjacent housing end wall and including an annular seal element disposed between the radially outer one of said pair of annular seal rings and the inner end of the adjacent rotor end wall and further in which the outer periphery of each of said rotor-hub-secured rings is radially spaced inwardly from the inner periphery of the rotor end wall to leave an annular passage therebetween providing communication between the bottom of its said notch and the interior compartments of the rotor.

8. A composite rotor as claimed in claim 6 and in which each said seal means includes an annular seal ring for sealing cooperation with the adjacent housing end wall and also includes means providing a seal between said annular seal ring and the inner end of the adjacent rotor end wall.

9. A composite rotor as claimed in claim 8 and in which the outer periphery of each said rotor-hub-secured rings is radially spaced inwardly from the inner periphery of the adjacent rotor end wall to leave an annular passage therebetween providing communication between the bottom of its said notch and the interior of the rotor.

* * * * *